United States Patent [19]

Vercoulen

[11] 4,363,858

[45] Dec. 14, 1982

[54] PHOTOCONDUCTIVE BELT JOINT

[75] Inventor: Johannes C. A. Vercoulen, Venlo, Netherlands

[73] Assignee: Ocè-van der Grinten N.V., Venlo, Netherlands

[21] Appl. No.: 689,359

[22] Filed: May 24, 1976

[30] Foreign Application Priority Data

May 28, 1975 [NL] Netherlands ..... 7506264

[51] Int. Cl.[3] ..... G03G 5/00

[52] U.S. Cl. ..... 430/56; 156/159

[58] Field of Search ..... 156/159, 258; 96/1.5, 96/1 R

[56] References Cited

U.S. PATENT DOCUMENTS 2,021,016 11/1935 Narath ..... 156/159

2,318,287 10/1939 Brolin ..... 156/159 UX 2,551,582 5/1951 Carlson ..... 96/1 R

*Primary Examiner*—John E. Kittle

*Assistant Examiner*—John L. Goodrow

*Attorney, Agent, or Firm*—Albert C. Johnston

[57] ABSTRACT

A photoconductive belt for use in an electrophotographic copying machine has extremities thereof joined together in a manner keeping one side of the belt even for smooth movement through electrophotographic processing stations yet avoiding loosening of the joint by backward and forward bendings of the belt in its path in the machine. The joined extremities have end edges formations which mainly interfit yet each comprises lips that extend over the surface of the other extremity, all the lips being at the same side of the belt and being covered by an adhesive strip that joins the extremities together.

4 Claims, 6 Drawing Figures

PHOTOCONDUCTIVE BELT JOINT

This invention relates to a photoconductive belt consisting of one or more photoconductive imaging elements, or belt lengths, having meeting ends thereof joined together by an adhesive strip.

Various forms or embodiments of such belts are known. In general they comprise a support composed of a flexible sheet material, such as of paper or plastic, having a photoconductive layer coated thereon. Such belts are used in indirect electrophotographic copying machines in which an electrostatic or a powder image is formed on the belt and subsequently is transferred to a receiving material, after which, with or without an intervening time interval, a new electrostatic or powder image can be formed on the previously imaged portion of the belt.

The photoconductive layer of such a belt can be used for image formation a considerable number of times, for instance 100–1,000 times, depending on the nature of the belt. In order to avoid need for early replacement of the belt, so that a great number of copies can be made with it, a long belt is used which is installed in the machine as a finite belt and then is made endless by joining the extremities with an adhesive strip.

Such a belt having its ends joined by an adhesive strip applied at the photoconductive side of the belt is satisfactory for uses in which, during the copying process, the joint made by the adhesive strip is bent only backwards when passing over rollers engaging the back or support side of the belt.

However, a simple joint made with an adhesive strip is not always satisfactory when the photoconductive belt in the copying machine is also bent forwards. Such bending exists, for instance, in a copying machine of the type described in a copending United States patent application of applicant's assignee, Ser. No. 663,710, filed Mar. 4, 1976, in which machine the photoconductive belt is conveyed in a meandering path over a number of reversing rollers installed in parallel rows, so that the belt is alternately bent backwards and forwards. When a relatively stiff belt, such as one having a photoconductive layer on a thick polyester film, is employed in such a copying machine, a joint between belt extremities as obtained, for instance, by an adhesive strip at the front of the belt results in the belt starting to come loose upon being bent forwards. Theoretically, this problem might be prevented if an adhesive strip were applied also at the rear of the belt, but this gives rise to a new problem by causing stresses or shocks to be applied unevenly to the belt in a direction perpendicular to its surface during the various processing steps such as charging, exposure, development and transfer. Moreover, this expedient detracts from the efficacy of devices provided in the machine to counteract side travel of the belt.

The object of the present invention is to overcome the disadvantages mentioned above without introducing new disadvantages.

According to the invention, in a photoconductive belt of the type mentioned at the outset, the joined extremities of the photoconductive belt length or lengths are each provided with protruding end edge portions, or lips, which extend at least in part over the surface of the meeting, or opposite extremity, all at the same side of the photoconductive belt, and are covered there by an adhesive strip joining the extremities together.

The electrophotographic belt according to the invention has no parts rising from the surface of the belt at one of its sides, yet it can be bent off towards either side without causing loosening of the joint. The absence of rising parts at one side of the belt makes it possible to prevent undesired stresses, shocks and vibrations in the belt at the stations where the copying process is taking place.

Parts rising beyond the normal surface of the belt usually are not desired at the support side of the photoconductive belt; so the lips ordinarily extend at least in part over the photoconductive side of the belt, which then is the side provided with the adhesive strip.

In many cases the adhesive strip can be applied straight onto the surface of the belt. In some cases, for instance when the top layer of the belt is composed of a photoconductor dispersed in a polymeric organic binder, it may be necessary to remove portions of this layer in order to obtain a belt surface suitable to be covered by the adhesive strip—either because the top layer lacks sufficient mechanical strength or because the adhesive strip does not adhere to it sufficiently.

The invention will be further understood from the following description and the accompanying drawings of illustrative embodiments. In the drawings.

Figure 1:
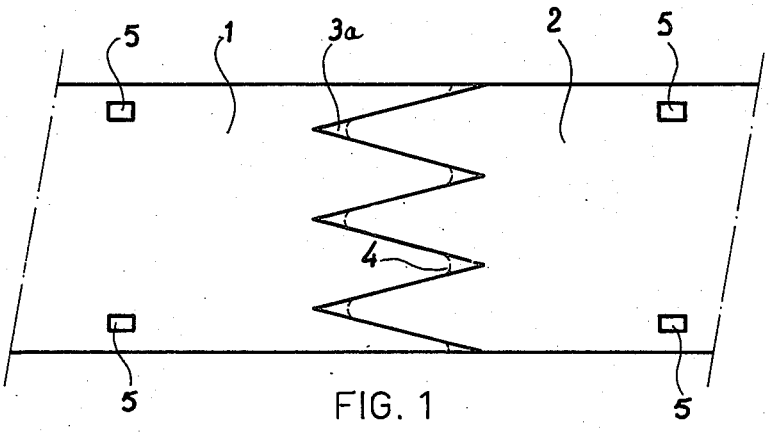
FIG. 1 is a schematic plan view of two interfitted extremities of a photoconductive belt according to a preferred embodiment of the invention, wherein the adhesive strip, though not itself shown, is located at the side shown.
Figure 3A:
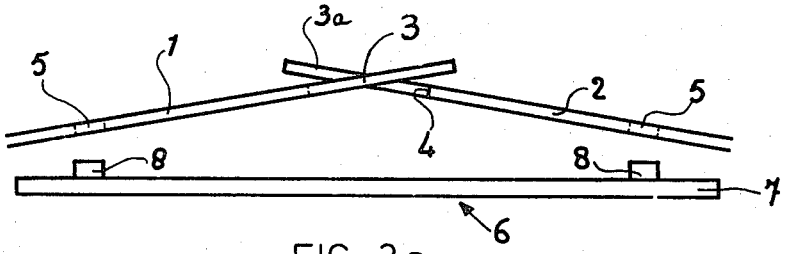
Figure 3B:
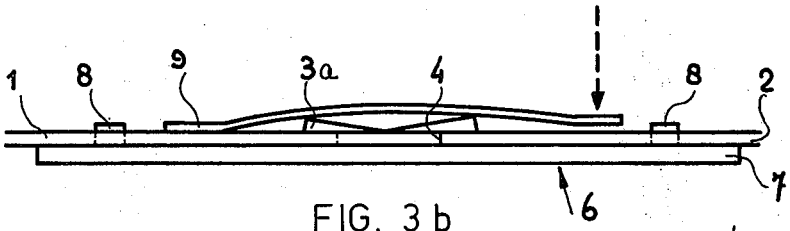
Figure 4:
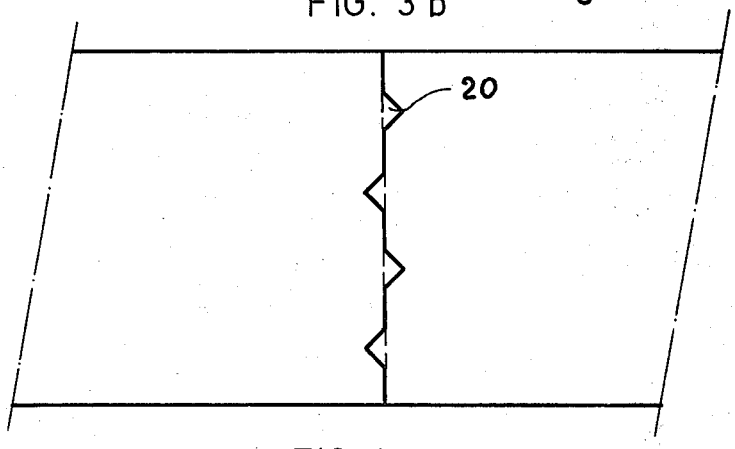
Figure 5:
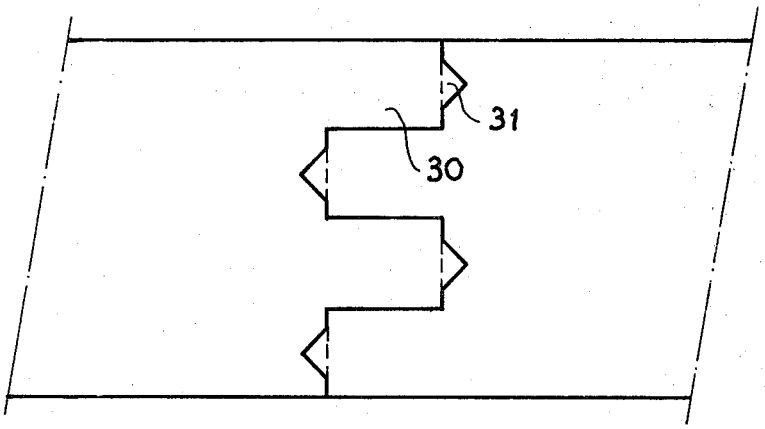

FIGS. 3*a* and 3*b* are schematic side views showing two stages of a procedure for joining extremities of the photoconductive belt according to FIG. 1, in which procedure use is made of a mounting device also shown in side view;

FIG. 4 is a schematic plan view of another embodiment of joined extremities of a photoconductive belt element according to the invention; and FIG. 5 is a schematic plan view of a third embodiment thereof.

Figure 2:
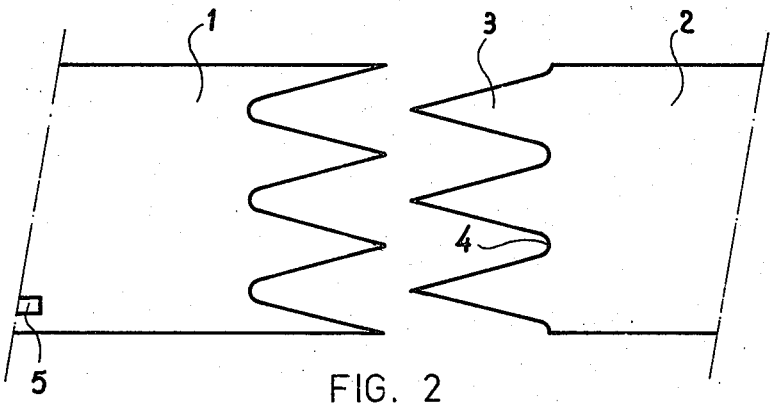
FIG. 2 shows the extremities of a photoconductive belt according to FIG. 1 separated from one another, for clearer illustration of the end edge formations.

Referring to FIG. 1 and FIG. 2 of the drawings, the joined edges of the extremities 1 and 2 of a photoconductive belt according to the embodiment of these figures each have a zigzag shape, or jagged shape, formed by protruding edge portions or lips 3 and intervening recesses, the lips 3 having sharp points 3*a* and the recesses having rounded valleys 4. The sharp points 3*a* form tips of the lips 3 which protrude at one end edge so far that they overlie and rest on portions of the surface of the opposite end edge bordering the rounded valleys of the opposite edge, while the flanks of the lips of the one edge interfit with the flanks of the lips of the other edge until they reach the parts of the lips that rest on the other edge. An adhesive strip not shown in FIG. 1 but as illustrated, for instance, at 9 in FIG. 3*b* is applied over the whole width of the belt so as to extend over all the lips of the interfitted belt ends.

As further illustrated in the drawings, the meeting photoconductive belt ends 1 and 2 are each provided with openings 5 which extend through the belt material at locations near the two side edges of the belt. These openings are utilized to facilitate the joining of the extremities of the belt by a procedure as illustrated in FIGS. 3*a* and 3*b*. As indicated in these figures, the belt ends 1 and 2 are brought together into an arched position, in which their surfaces at the back or support side of the belt form an angle with each other smaller than 180°, by sliding the lips of each end into the recesses of the other end. The parts slid into each other are then, with the support side facing downward, laid down flatly onto a mounting device 6 which consists of a flat plate 7 having four pegs 8 protruding upwardly from the plate so that they will fit closely into the openings 5 in the extremities of the photoconductive belt. The interfitting lips of the belt ends 1 and 2 so laid down onto the mounting device are firmly engaged together side by side and in the normal flat plane of the belt, except where the tips 3 overlap the bases of the valleys 4, as indicated in FIG. 3*b*. The adhesive strip 9 is then applied over the whole joint as indicated in that figure.

The mounting device 6 can be used as a simple loose tool for joining the belt extremities either before or after installation of the belt in a photo copying machine. In an alternative embodiment, the mounting device is mounted firmly in an electrophotographic copying machine at a location enabling the extremities of the photoconductive belt to be joined readily after installation of the belt in the machine.

In another embodiment of an electrophotographic belt according to the invention, of which the joined extremities are illustrated in FIG. 4, the end edges are mainly straight and at equal intervals are each provided with triangular lips 20, all of which rest almost fully on straight portions of the opposite or meeting extremity of the belt. The belt is provided with an adhesive strip (not shown) which extends over all the lips at the side where the lips rest on the belt.

According to a third embodiment, as illustrated in FIG. 5, the joined end edges of the belt have the shape of battlements the tops 30 of which are provided with triangular lips 31. The two battlement-shaped edges are complementary to each other and almost entirely fit into each other, while the lips of the one edge almost entirely rest on the opposite belt end at the base of valleys beside the battlements of the other edge. Again, over the side where the lips rest on the belt, the belt is provided with an adhesive strip (not shown) which extends over all lips.

The invention is not limited to the embodiments described. For instance, the lips 31 in the embodiment according to FIG. 5 can be omitted and the battlements caused to function as lips by resting partially on the opposite end of the belt. In still another embodiment, the end edges can mainly have the shape of a dovetail joint, with the tip of each dovetail partially resting on the opposite extremity of the belt; or the tips can be provided with additional lips which rest on the opposite extremity. The joined edges may also have more or less the shape of a sinus, with the tops of the curvatures of one edge partially resting on the other extremity at the base of the valleys of the opposite edge.

What is claimed is:

1. In a photoconductive belt comprising a support of flexible sheet material having a photoconductive layer thereon, said belt having a joint therein formed by meeting extremities of a length or lengths thereof and an adhesive strip applied over said extremities, the improvement which comprises said extremities respectively having end edges mainly fitting with each other and each said extremity including lips extending at least in part over the surface of the other extremity, all said lips being at the same side of said belt and being covered by said adhesive strip.

2. A photoconductive belt according to claim 1, said extremities each having a jagged shape formed by protruding end portions beside recessed end portions, said protruding portions of each extremity interfitting with said recessed portions of the other and having tip portions constituting said lips.

3. A photoconductive belt according to claim 2, said protruding portions having pointed tips and said recessed portions each having a rounded valley at its base, said pointed tips constituting said lips and each extending over the base of one of said valleys.

4. A photoconductive belt according to claim 1, an adhesive strip being applied to said same side only of said belt.

* * * * *